US009248453B2

(12) United States Patent
Pfoltner et al.

(10) Patent No.: US 9,248,453 B2
(45) Date of Patent: Feb. 2, 2016

(54) CUTTING TOOTH FOR A ROTARY CUTTER

(71) Applicant: Vermeer Manufacturing Company, Pella, IA (US)

(72) Inventors: Christopher A. Pfoltner, Knoxville, IA (US); Gary W. Kappel, Pella, IA (US)

(73) Assignee: Vermeer Manufacturing Company, Pella, IA (US)

( * ) Notice: Subject to any disclaimer, the term of this patent is extended or adjusted under 35 U.S.C. 154(b) by 428 days.

(21) Appl. No.: 13/899,827

(22) Filed: May 22, 2013

(65) Prior Publication Data

US 2014/0346263 A1 Nov. 27, 2014

(51) Int. Cl.
*B02C 18/18* (2006.01)
*B02C 18/14* (2006.01)

(52) U.S. Cl.
CPC ..... *B02C 18/18* (2013.01); *B02C 18/145* (2013.01)

(58) Field of Classification Search
CPC ..... B02C 18/18; B02C 18/145
USPC ..... 241/294
See application file for complete search history.

(56) References Cited

U.S. PATENT DOCUMENTS

| | | | | |
|---|---|---|---|---|
| 3,642,214 | A | 2/1972 | Blackwell | |
| 4,765,217 | A | 8/1988 | Ludwig | |
| 4,785,860 | A | 11/1988 | Arasmith | |
| 5,060,875 | A | 10/1991 | McBride | |
| 5,165,611 | A | 11/1992 | Ragnarsson | |
| 5,183,089 | A | 2/1993 | Norlander | |
| 5,484,111 | A | 1/1996 | Dorscht | |
| 5,950,945 | A | 9/1999 | Schaller | |
| D447,757 | S | 9/2001 | Rautio | |
| 6,764,035 | B2 | 7/2004 | Denis | |
| 7,055,770 | B2 | 6/2006 | Bardos | |
| 7,584,921 | B1 * | 9/2009 | Bennington | B02C 18/145 241/294 |
| 7,708,039 | B2 | 5/2010 | Pallmann | |
| 7,810,531 | B2 | 10/2010 | Labbe | |
| 7,967,044 | B2 | 6/2011 | Labbe | |
| 2010/0206973 | A1 | 8/2010 | Cotter | |
| 2012/0067188 | A1 | 3/2012 | Denis | |

FOREIGN PATENT DOCUMENTS

| | | |
|---|---|---|
| WO | 2012012873 | 2/2012 |

* cited by examiner

*Primary Examiner* — Mark Rosenbaum
(74) *Attorney, Agent, or Firm* — Sturm & Fix LLP

(57) ABSTRACT

A cutting tooth for a rotary cutter that has a mounting bore arranged such that when a fastener disposed in the mounting bore is used to attach the cutting tooth to a tooth holder, the cutting tooth is attached into the holder so as to pull both a rear trailing surface and a bottom radially inner surface into tight contact with abutting surfaces of the tooth holder.

23 Claims, 4 Drawing Sheets

CUTTING TOOTH FOR A ROTARY CUTTER

TECHNICAL FIELD

This invention relates generally to a cutting tooth for a rotary cutter and more particularly to a cutting tooth mounting structure which holds the cutting tooth tighter against at least two abutting surfaces of a tooth holder.

BACKGROUND

FIG. 1 of this patent document shows a representative figure for U.S. Pat. No. 5,950,945 to Schaller (which is incorporated herein by reference), wherein a replaceable tooth PA1 has a leading face PA2, a trailing face PA3, a radially outer face PA4 and a radially inner face PA5. The leading face PA2 has cutting portion PA6 on it. The trailing face PA3 is disposed along a first plane PA7 and a radially inner face PA5 is disposed in a second plane PA8. The replaceable tooth PA1 is held in place with a threaded fastener PA10 disposed along a longitudinal axis PA11 in a tooth holder PA9. The axis PA11 is disposed at an angle of PAa with respect to the plane PA8 coincident with the radially inner face PA5.

Still referring to FIG. 1, the longitudinal axis PA11 intersects the plane PA8 at a point (PA12) in front of the leading edge PA2 of the tooth PA1 as it rotates about a rotational axis (not shown). Due to that just described structural relationship, when the threaded fastener PA10 of the Schaller device is tightened, the trailing face PA3 of the Schaller cutting tooth PA1, as shown herein in FIG. 1, is pulled against the leading face PA14 of the tooth holder PA12. However, also as a result of that tightening procedure, the bottom or radially inner face PA5 of the Schaller tooth PA1 has forces on it in use tending to cause it to be pulled away from the mating surface PA15 of the tooth holder PA12. So, the tightness being increased on only one of the abutting surfaces PA3/PA14, instead of on both abutting surfaces, PA3/PA14 and PA5/PA15, makes the tooth PA1 less stable than it could otherwise be. This problem will be explained in more detail in the following paragraph and in relation to FIGS. 1A and 1B.

FIGS. 1A and 1B show the forces on the Schaller prior art tooth PA1 of FIG. 1 wherein, as shown in FIG. 1A, a vector PAV extending generally from the leading face PA2 towards the trailing face PA3 along the longitudinal center PA11 can be broken into a component PAVC1 perpendicular to and directed towards the trailing face PA3 and a corresponding component PAVC2 parallel to the trailing face PA3 that is directed towards the radially inner face PA5; and FIG. 1B shows a component PAVC3 perpendicular to and directed away from (not towards as in the present invention) the radial inner face PA5 and a corresponding component PAVC4 parallel to the inner face PAVC4 that is directed towards the trailing face PA3.

Accordingly, there is a need for a cutting tooth and holder wherein a tightening of a cutting tooth fastener will pull both a rear or trailing face PA3 and a bottom or radially inner face PA5 of the tooth against abutting surfaces of a tooth holder, whereby both the rear and bottom surfaces of the cutting tooth are in a tight abutting relationship with the abutting surfaces of the tooth holder, as result of a positive force vector being induced against both of those surfaces.

BRIEF DESCRIPTION OF THE DRAWINGS

The above identified need is at least partially met through provision of the apparatus described in the following detailed description, particularly when studied in conjunction with the drawings, wherein.

Elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. Certain actions and/or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein.

DETAILED DESCRIPTION

Figure 1:
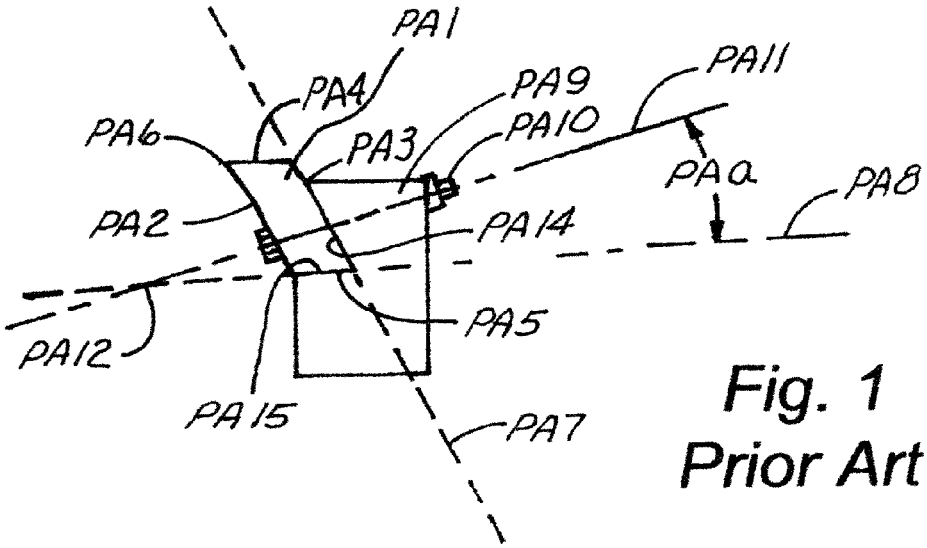
Fig. 1 Prior Art
FIG. 1 is a side view of a cutting tooth in a tooth holder of the type for attachment to a rotor such as that shown in U.S. Pat. No. 5,950,945 to Schaller.
Figure 1A:
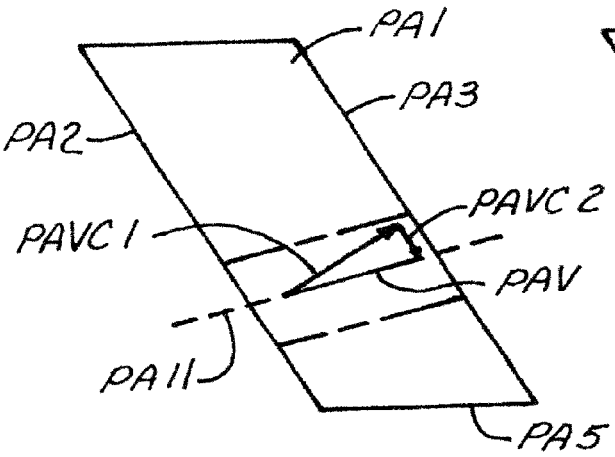
Fig. 1A Prior Art
FIGS. 1A and 1B show a force vector along a longitudinal center of a bore in the cutting tooth of FIG. 1 broken into force vector components.
Figure 1B:
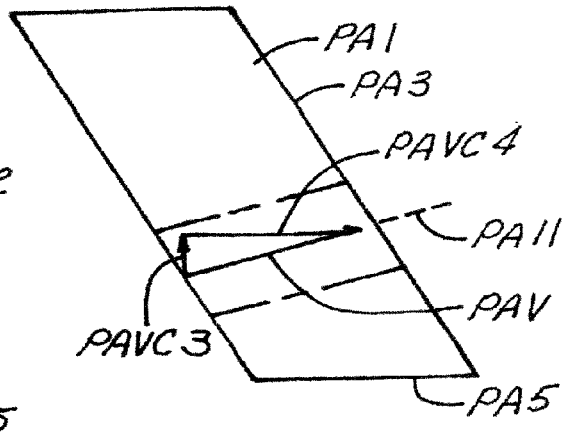
Fig. 1B Prior Art

Referring now to the drawings, wherein like reference numerals indicate identical or similar parts throughout the several views, FIGS. 1, 1A and 1B show a typical prior art cutting tooth of the type mounted to a rotor and FIGS. 2-6 show preferred embodiments of cutting teeth constructed in accordance with the present invention.

Figure 2:
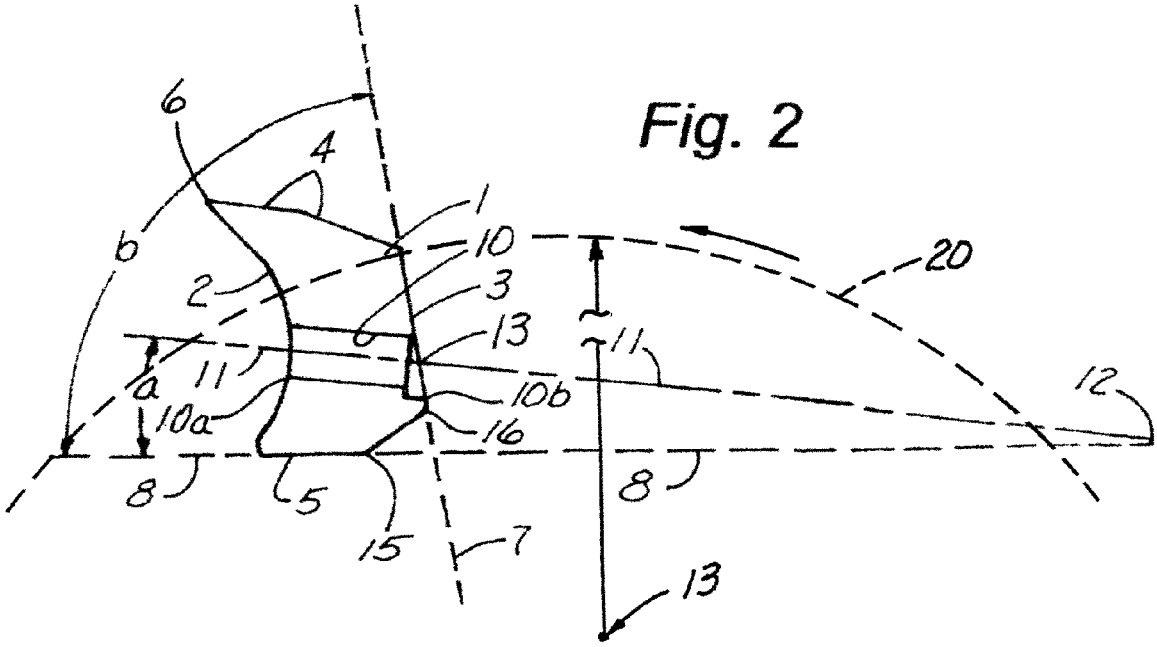
FIG. 2 is a cross sectional view of a first embodiment of the cutting tooth of the present invention.

FIG. 2 shows a cutting tooth body (1) adapted to be rotated about a rotary axis (13). The tooth body (1) has a leading face (2), a trailing face (3), a radially outer face (4) and a radially inner face (5). A radially outer part (6) of the leading face (2) has a cutting surface (6) on it. The trailing face (3) is disposed generally in a first plane (7) and the radially inner face (5) is disposed generally in a second plane (8). The cutting surface (6) may be in the form of a shear edge, a grinding surface, or any other edge or surface that facilitates a cutting, tearing, shredding, or other size-reducing action when contacting a body (not shown) that is to be nominally cut or reduced in size.

A mounting bore (10) is disposed in the tooth body (1) and extends at least through the trailing face (3), the mounting bore (10) having a centrally-located longitudinal axis or centerline (11) of the mounting bore (10), the longitudinal axis (11) extending through the first plane (7). The mounting bore axis (11) is defined by an acute bore angle (a) relative to the radially inner face (5), the mounting bore axis (11) inclining away from the radially inner face (5) while approaching the leading face (2). This is graphically illustrated by the fact that the mounting bore axis (11) crosses the plane (8) behind the tooth (1) at point (12) as it rotates about a rotational axis (13), as contrasted from the prior art shown in FIG. 1, wherein the point PA12 shown in FIG. 1 is the point where the mounting bore axis PA11 crosses the plane PA8, doing so in front of the leading face PA2. The acute angle (a) is ideally 7 degrees but can fall in the range of 2-15 degrees. The lower end of the given range 2-15 degrees ensures that a measurable downward force vector (VC2/VC3/VC6/VC7) component would result upon mounting, while the upper end of the range 2-15 degrees takes into account the need for sufficient space/clearance to exist in order to facilitate the insertion of a given threaded fastener (25) into place.

Looking to FIG. 2 it is noted that the longitudinal axis (11) crosses the second plane (8) at an acute angle behind the trailing face (3) at a point (12) resulting in a positive force vector on both the trailing face (3) and the radially inner face (5) when the bolt (25) is tightened. This is in contrast to the prior art tooth (PA1) of FIG. 1 wherein the longitudinal axis (PA11) crosses the second plane (PA8) at an acute angle at point (PA12) in front of the trailing face (PA3) so that there is a positive force vector only on the trailing face (PA 3) but not on the radially inner face (PA5) when the bolt/nut PA10 is tightened.

A rearmost part (15) of the radially inner face (5) lies in the second plane (8) is forward of the first plane (7) and a radially innermost part (16) of the trailing face (3) lies in the first plane (7) spaced radially outwardly from the second plane (8), thereby avoiding a sharp corner between the trailing face (3) and the radially inner face (5). In other words, the cutting tooth (1) forms a bevel face between points (15) and (16), the bevel face extending between the trailing face (3) and the radially inner face (5), the bevel face being at a respective bevel angle relative to each of the trailing face (3) and the radially inner face (5). The lack of a sharp corner at the junction of the trailing face (3) and the radially inner face (5) facilitates the adaptable/maneuverable positioning of the cutting tooth (1) during mounting thereof to the position of the tooth (1) in holder (21) as shown in FIG. 3.

Figure 6:
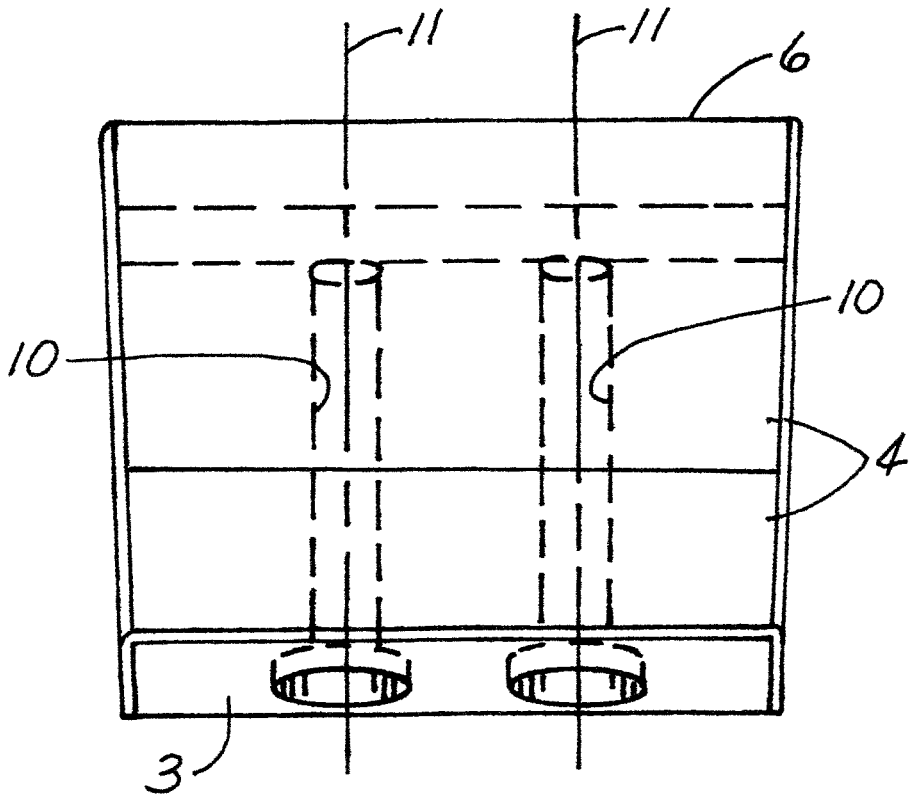
FIG. 6 is a top view of the cutting tooth of FIG. 2, showing two mounting bores in dashed lines.

During rotation of the cutting tooth (1) about the rotary axis (13), the longitudinal axis (11) of the mounting bore is preferably disposed in a third plane which is perpendicular to the rotary axis (13), so that if there are two or more mounting bores 10, they are essentially parallel with each other. But the axes (11) of the mounting bores (10) are not required to be parallel, as shown in FIG. 6. Only one mounting bore (10) is required, however.

Referring to FIG. 2, the mounting bore (10) has a first bore opening (10*a*) defined in the leading face (2) and a second bore opening (10*b*) in the trailing face (3), as can be seen clearly in FIG. 2, though it is not a requirement for the bore (10) to extend that far. The first bore opening (10*a*) is spaced at a first opening distance from the radially inner face (5), and the second bore (10*b*) is spaced at a second opening distance from the radially inner face, the first opening distance being greater than the second opening distance. FIG. 2 shows that the second bore (10*b*) is defined in the trailing face (3). In the preferred embodiments shown in FIGS. 2, 3, 4A and 4B the second plane (8) intersects the first plane (7) at an acute angle (b) (FIG. 2) as measured through the tooth body (1) from the trailing face (3) to the radially inner face (5). This geometry causes a preferred wedge like structure. But in the preferred embodiment of FIGS. 5A and 5B that angle (c) between the first plane (7) and the second plane (8) is not acute, but is oblique, so in some cases that angle may be 90 degrees or more.

Figure 3:
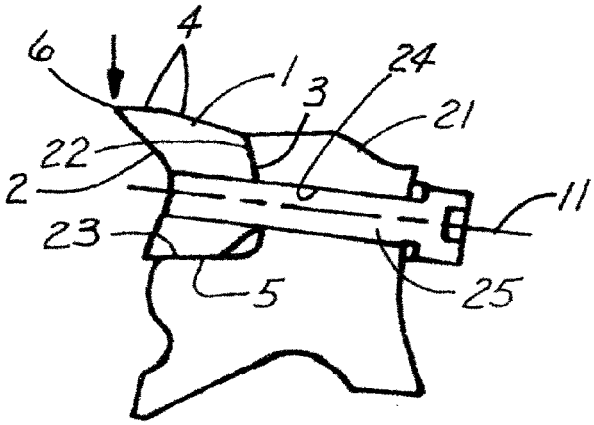
FIG. 3 is a cross sectional view of the cutting tooth of FIG. 2 shown in a tooth holder.

Referring now to FIGS. 2 and 3, in use, the cutting tooth (1) is attached to the outer periphery of a rotor (20) and is configured for rotating in the first direction around the rotary axis (13). A tooth mounting structure (21) is operatively attached to an outer portion of the rotor (20). The tooth mounting structure (21) has a first wall (22) disposed along the first plane (7) in abutment with the trailing face (3) of the cutting tooth and a second wall (23) disposed along the second plane (8) in abutment with the radially inner face (5) of the tooth. A bore (24) in the tooth mounting structure (21) has a longitudinal center coaxially disposed along the longitudinal axis (11) of the bore (10) in the tooth (1). A fastener such as threaded bolt (25) is disposed in both the mounting bore (10) in the cutting tooth and in the bore (24) in the tooth mounting structure (21) for holding the cutting tooth (1) in place. The bore (10) in the tooth (1) may be threaded to facilitate engagement with the threaded bolt (25) to hold the cutting tooth (1) in place.

The fastener (25) is a threaded fastener such as a bolt (25), whereby rotation of the threaded fastener (25) in one direction pulls the trailing face (3) of the tooth in abutment with the first wall (22) of the tooth mounting structure, while at the same time pulling the radially inner face (5) of the cutting tooth against the second wall (23) of the tooth mounting structure. Further, rotation of the threaded fastener (25) in an opposite direction causes loosening of the tooth with respect to the tooth mounting structure. Of course the rotor could be any kind of a cutter or grinder. For example, it could be a drum on a brush chipper.

Figure 4A:
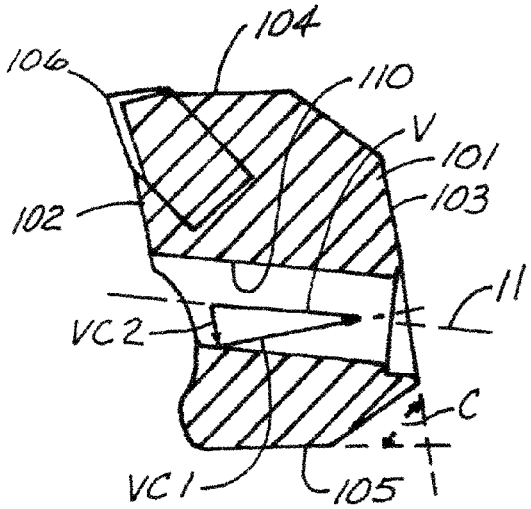
FIGS. 4A and 4B are cross sectional views of a second embodiment of the cutting tooth of the present invention, showing a breakdown of a force vectors due to bolt clamp force acting at the center line of the bore in the cutting tooth for comparison to the force vector analysis of the prior art, as shown in FIGS. 1A and 1B respectively.
Figure 4B:
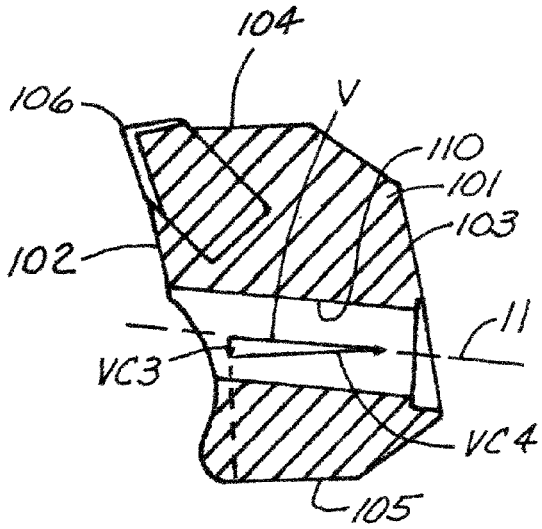

Referring now to a second embodiment shown in FIGS. 4A and 4B, a cutting tooth (101) is shown and is adapted to be rotated about a rotary axis (13) like that shown in FIG. 3. The cutting tooth body (101) has a leading face (102), a trailing, generally planar, face (103), a radially outer face (104), and a radially inner, generally planar, face (105). A radially outer part (106) of the leading face (102) has a cutting surface (106) on it. A mounting bore (110) disposed in the tooth body has a longitudinal center (11) oriented such that a vector (V) extending generally from the leading face towards the trailing face along the longitudinal center (11) can be broken into:

- a component (VC1) (FIG. 4A) perpendicular to and directed towards the trailing face (103) and a corresponding component (VC2) parallel to the trailing face (103) that is directed towards the radially inner face (105); and
- a component (VC3) (FIG. 4B) perpendicular to and directed towards the inner face (105) and a corresponding component (VC4) parallel to the radially inner face (105) that is directed towards the trailing face (103). Stated another way, a mounting bore (110) disposed in the tooth body (101) has a longitudinal bore centerline (11), the bore centerline (11) being positioned at an acute angle with respect to the radially inner face (105) and being oriented along a slope vector that can be broken into: 1) a rise component (VC3) directed downward and perpendicular to the inner face (105); and 2) a run component (VC4) parallel to the inner face (105) and generally directed towards the trailing face (103) as shown in FIG. 4B.

In the embodiment of FIGS. 4A and 4B the angle (c) between the trailing face (103) and the radially inner face (105) is acute forming a wedge shaped cutting tooth (101).

Figure 5A:
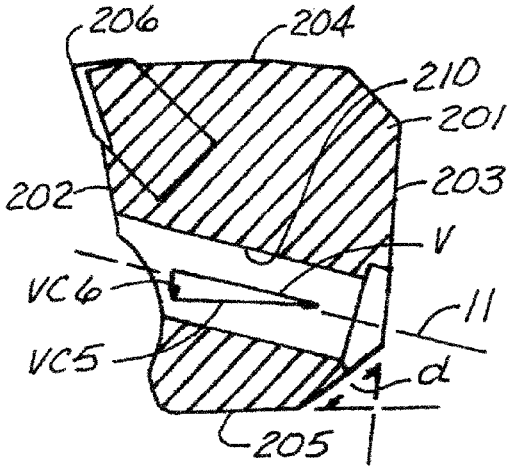
FIGS. 5A and 5B are cross sectional views of a third embodiment of the cutting tooth of the present invention, showing a breakdown of a force vectors due to bolt clamp force acting at the center line of the bore in the cutting tooth for comparison to the force vector analysis of the prior art, as shown in FIGS. 1A and 1B respectively.
Figure 5B:
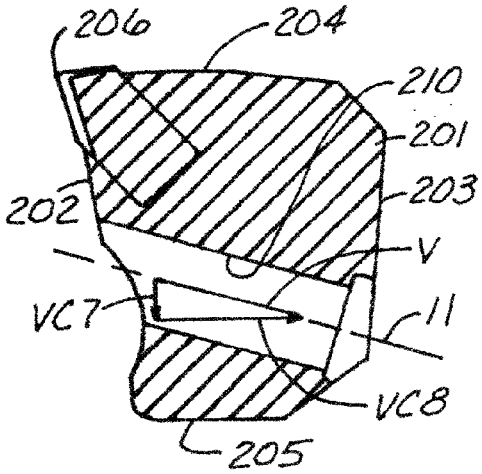

The embodiment 201 of FIGS. 5A and 5B is essentially like the cutting tooth (101) of FIGS. 4A and 4B except that the angle (d) between the plane of the trailing face (203) and the radially inner face (205) is obtuse instead of acute. A mounting bore (210) disposed in the tooth body (201) has a longitudinal center (11) oriented such that a vector (V) extending generally from the leading face towards the trailing face along the longitudinal center (11) can be broken into:

a component (VC5) (FIG. 5A) perpendicular to and directed towards the trailing face (203) and a corresponding component (VC6) parallel to the trailing face (203) that is directed towards the radially inner face (205)); and a component (VC7) (FIG. 5B) perpendicular to and directed towards the inner face (205) and a corresponding component (VC8) parallel to the radially inner face (205) that is directed towards the trailing face (203).

Those skilled in the art will recognize that a wide variety of modifications, alterations, and combinations can be made with respect to the above described embodiments without departing from the spirit and scope of the invention, and that such modifications, alterations, and combinations are to be viewed as being within the ambit of the inventive concept as expressed by the attached claims.

We claim:

1. A cutting tooth adapted to be rotated about a rotary axis comprising:

a tooth body having a leading face , a trailing, generally planar, face , a radially outer face and a radially inner, generally planar, face;

a radially outer part of the leading face having a cutting surface on it;

a mounting bore disposed in the tooth body having a longitudinal axis oriented such that a vector extending generally from the leading face towards the trailing face along the longitudinal axis can be broken into:

a component perpendicular to and directed towards the trailing face and a corresponding component parallel to the trailing face that is directed towards the radially inner face; and a component perpendicular to and directed towards the inner face and a corresponding component parallel to the radially inner face that is directed towards the trailing face .

2. A cutting tooth of claim 1 wherein the angle between the trailing face and the radially inner face is of not more than 90°.

3. The cutting tooth of claim 1 further comprised in combination with:

a rotor configured for rotating in the first direction around the rotary axis; and a tooth mounting structure disposed on an outer portion of the rotor, the tooth mounting structure having a first wall disposed along the first plane in abutment with the trailing face of the cutting tooth and a second wall disposed along the second plane in abutment with the radially inner face of the tooth.

4. The cutting tooth combination of claim 3 further comprising a bore in the tooth mounting structure centrally disposed along the longitudinal axis of the bore in the cutting tooth.

5. The cutting tooth combination of claim 4 further comprising a fastener disposed in both the mounting bore in the cutting tooth and the bore in the tooth mounting structure, the fastener being configured for holding the cutting tooth in place.

6. The cutting tooth combination of claim 5 wherein the fastener is a threaded fastener, and the mounting bore in the cutting tooth is matingly threaded, whereby rotation of the threaded fastener in one direction pulls the trailing face of the tooth in abutment with the first wall of the tooth mounting structure, while at the same time that same rotation pulls the radially inner face of the cutting tooth against the second wall of the tooth mounting structure; and whereby rotation of the threaded fastener in an opposite direction causes loosening of the tooth with respect to the tooth mounting structure.

7. The cutting tooth of claim 3 wherein the rotor is a chipper drum.

8. A cutting tooth adapted to be rotated about a rotary axis comprising:

a tooth body having a leading face , a trailing, generally planar, face , a radially outer face and a radially inner, generally planar, face , the trailing face and the inner face defining an angle of not more than 90° therebetween;

a radially outer part of the leading face having a cutting surface on it; and a mounting bore disposed in the tooth body having a longitudinal bore centerline, the bore centerline being positioned at an acute angle with respect to the inner face and being oriented along a slope that can be broken into: 1) a rise component directed downward and perpendicular to the inner face; and 2) a run component parallel to the inner face and generally directed towards the trailing face.

9. A cutting tooth of claim 8 wherein the angle between the trailing face and the radially inner face is acute.

10. The cutting tooth of claim 8 further comprised in combination with:

a rotor configured for rotating in the first direction around the rotary axis; and a tooth mounting structure disposed on an outer portion of the rotor, the tooth mounting structure having a first wall disposed along the first plane in abutment with the trailing face of the cutting tooth and a second wall disposed along the second plane in abutment with the radially inner face of the tooth.

11. The cutting tooth combination of claim 10 further comprising a bore in the tooth mounting structure centrally disposed along the longitudinal axis of the bore in the cutting tooth.

12. The cutting tooth combination of claim 11 further comprising a fastener disposed in both the mounting bore in the cutting tooth and the bore in the tooth mounting structure, the fastener being configured for holding the cutting tooth in place.

13. The cutting tooth combination of claim 12 wherein the fastener is a threaded fastener, and the mounting bore in the cutting tooth is matingly threaded, whereby rotation of the threaded fastener in one direction pulls the trailing face of the tooth in abutment with the first wall of the tooth mounting structure, while at the same time that same rotation pulls the radially inner face of the cutting tooth against the second wall of the tooth mounting structure; and whereby rotation of the threaded fastener in an opposite direction causes loosening of the tooth with respect to the tooth mounting structure.

14. The cutting tooth of claim 10 wherein the rotor is a chipper drum.

15. A cutting tooth adapted to be rotated about a rotary axis comprising:

a tooth body having a leading face , a trailing face , a radially outer face and a radially inner face;

a radially outer part of the leading face having a cutting surface on it;

the trailing face being disposed generally in a first plane;

the radially inner face being disposed generally in a second plane;

a mounting bore disposed in the tooth body and extending at least through the trailing face, the mounting bore being centrally located along a longitudinal axis of the mounting bore, the longitudinal axis extending through the first plane; and the mounting bore axis defining an acute bore angle relative to the radially inner face, the mounting bore axis inclining away from the radially inner face while approaching the leading face.

16. The cutting tooth of claim 15 wherein the cutting tooth further defines a bevel face, the bevel face extending between the trailing face and the radially inner face , the bevel face being at a respective bevel angle relative to each of the back face and the bottom face.

17. The cutting tooth of claim 15 wherein the mounting bore defines at least one bore opening.

18. The cutting tooth of claim 17 wherein the mounting bore has a first bore opening defined in the leading face and a second bore opening in the trailing face.

19. The cutting tooth of claim 18 wherein the first bore opening is vertically spaced at a first bore opening distance from the radially inner face and the second bore opening is spaced at a second bore opening distance from the radially inner face, the first bore opening distance being greater than the second bore opening distance.

20. The cutting tooth of claim of claim 15 wherein the acute angle is 2 to 15 degrees.

21. The cutting tooth of claim of claim 15 wherein the second plane intersects the first plane at an acute angle as measured through the tooth body from the trailing face to the radially inner face.

22. The cutting tooth of claim 15 further comprised in combination with:

a rotor configured for rotating in the first direction around the rotary axis; and a tooth mounting structure disposed on an outer portion of the rotor, the tooth mounting structure having a first wall disposed along the first plane in abutment with the trailing face of the cutting tooth and a second wall disposed along the second plane in abutment with the radially inner face of the tooth.

23. The cutting tooth combination of claim 22 further comprising a bore in the tooth mounting structure centrally disposed along the longitudinal axis of the bore in the tooth; and a fastener disposed in both the mounting bore in the cutting tooth and the bore in the tooth mounting structure, the fastener being configured for holding the cutting tooth in place.

* * * * *